US006758505B2

(12) United States Patent
Hautmann et al.

(10) Patent No.: US 6,758,505 B2
(45) Date of Patent: Jul. 6, 2004

(54) LOCKING-MECHANISM CONTROL MEANS

(75) Inventors: Dieter Hautmann, Schwarzenbach/Saale (DE); Oliver Sommer, Hof/Saale (DE); Jürgen Hofmann, Tauperlitz (DE)

(73) Assignee: Sommer Metallbau-Stahlbau GmbH & Co. KG, Döhlau (DE)

( * ) Notice: Subject to any disclaimer, the term of this patent is extended or adjusted under 35 U.S.C. 154(b) by 0 days.

(21) Appl. No.: 10/191,898

(22) Filed: Jul. 8, 2002

(65) Prior Publication Data

US 2003/0111847 A1 Jun. 19, 2003

(30) Foreign Application Priority Data

Dec. 18, 2001 (DE) ..... 101 62 194

(51) Int. Cl.[7] ..... E05B 63/20

(52) U.S. Cl. ..... 292/332; 292/DIG. 41; 292/DIG. 21; 292/DIG. 26

(58) Field of Search ..... 292/DIG. 41, DIG. 21, 292/332, 333, 336, 97, 98, 99, DIG. 26

(56) References Cited

U.S. PATENT DOCUMENTS

| | | | | | |
|---|---|---|---|---|---|
| 4,923,233 | A | * | 5/1990 | Daily | 292/332 |
| 4,950,005 | A | * | 8/1990 | Cudd | 292/150 |
| 4,961,602 | A | * | 10/1990 | Pettersson | 292/98 |
| 5,076,620 | A | * | 12/1991 | Campbell et al. | 292/138 |
| 5,197,771 | A | * | 3/1993 | Kaup et al. | 292/45 |
| 5,265,920 | A | | 11/1993 | Kaup et al. | 292/40 |
| 6,174,004 | B1 | * | 1/2001 | Picard et al. | 292/165 |
| 6,254,149 | B1 | * | 7/2001 | Shaffer et al. | 292/333 |
| 6,389,855 | B2 | | 5/2002 | Renz et al. | 70/107 |

FOREIGN PATENT DOCUMENTS

| | | | |
|---|---|---|---|
| DE | 9112547.2 | | 2/1993 |
| DE | 29518005 | | 1/1996 |
| DE | 29605517 | | 7/1997 |
| DE | 9007232.4 | | 9/1997 |
| DE | 19628010 | | 1/1998 |
| DE | 19628011 | A1 | 1/1998 |
| DE | 19628012 | A1 | 1/1998 |
| DE | 196280011 | A1 * | 1/1998 |
| DE | 4014046 | | 12/1998 |
| EP | 0454966 | A1 | 11/1991 |

* cited by examiner

*Primary Examiner*—J. J. Swann
*Assistant Examiner*—Dinesh Melwani
(74) *Attorney, Agent, or Firm*—Sughrue Mion, PLLC

(57) ABSTRACT

A locking-mechanism control means having a push rod which controls the adjustment of door-mounted catches, it being possible for the catches to be locked in relation to the door frame, having a first and a second adjustable blocking device arranged in the door. It is further possible for said blocking devices to be adjusted in dependence on the door movement, and one of the blocking devices arresting the push rod in the open position when the door is open. A driver is provided on the push rod and can be coupled to a rod which executes a movement corresponding to the push rod in order for an arresting unit, which engages with the door in the closed state of the latter, to be displaced out of engagement with the door in the open position of the latter.

8 Claims, 6 Drawing Sheets

2
3
4
4a
1
36a
36
7
5

LOCKING-MECHANISM CONTROL MEANS

BACKGROUND

The invention relates to a loocking-mechanism control means.

DE 196 28 010, DE 196 28 011 and DE 196 28 012 describe locking-mechanism control means in the case of which a movement of a push rod released, for example, by a lock causes lateral catches to be adjusted, with the result that the lateral catches, in dependence on the relevant movement of the push rod, are adjusted between an open position and a closed position. The main aim of this locking-mechanism control means is to avoid accidental adjustment of the catches into the closed position once the catches have been adjusted into the open position following opening of the door. For this purpose, blocking devices, preferably in the form of adjustable rods, are provided for the abovementioned locking-mechanism control means, one blocking device serving for preventing the movement of the push rod in the case of the open position, in order to prevent the catches from extending when the door is open, while the other blocking device avoids adjustment of the first blocking device out of that position in which the first blocking device blocks the push-rod displacement.

It has been found in practice that, in the case of incomplete opening of the locking mechanism, i.e. in the case of movement of the push rod into the open position not fully executed on account of adjustment problems, the catches may be displaced, at least in part, in the direction of the closed position again although the door is already open.

SUMMARY

The object of the invention is thus to improve a locking-mechanism control means of the type mentioned in the introduction such that, once the door has been opened, the catches are reliably prevented from extending again.

This object is achieved according to the invention by the features specified in Patent claim 1.

Further configurations of the locking-mechanism control means can be gathered from the subclaims.

The invention relates to a locking-mechanism control means. For the overall functioning of such a locking-mechanism control means, you are expressly referred to DE 196 28 010, DE 196 28 011 and DE 196 28 012.

The locking-mechanism control means according to the invention differs from the known locking-mechanism control means essentially by the fact that the push rod is coupled to a driver device which, during movement of the push rod into that position in which the catches are open, displaces a piston rod, which is provided on the door, such that the free end of the piston rod disengages a frame-mounted blocking bolt from the door. In order to achieve this, the piston rod has to be adjusted to the extent where the blocking bolt disengages fully from the door, which, in turn, is only achieved when the push-rod movement is fully executed such that the catches are displaced not just in part, but fully into their open position, in which they can be arrested in relation to the push rod by driver bolts. If, in contrast, the push rod is not displaced as far into that position in which arresting between the catch and push rod is ensured, it is also the case that the piston rod is not extended to the extent where the blocking bolt disengages from the door. Accordingly, the door can only be opened when, following full actuation of the door handle, which brings about the push-rod displacement, or of the relevant handgrip, in the lock region, the piston rod is extended to the extent where the frame-mounted blocking bolt is displaced out of engagement with the door. The movement of the piston rod here is a control for the adjustment of the push rod.

In the case of one embodiment of the locking control means, the piston rod is provided such that it can be adjusted in the vertical direction, and the catch, when the door is closed, is located in the door frame, above the door, in alignment with the piston rod, and is preferably prestressed resiliently, i.e. prestressed resiliently in the downward direction, towards the door. Formed in the top end edge of the door is an opening in which the blocking bolt engages, on account of its spring prestressing, when the piston rod, on account of the closed position of the push rod, has been retracted or drawn back into the door.

Further configurations and embodiments of the locking-mechanism control means according to the invention can be gathered from the subclaims.

A preferred embodiment of the locking-mechanism control means is described hereinbelow with reference to the drawings for the purpose of explaining further features and advantages.

DETAILED DESCRIPTION

A preferred embodiment of the locking-mechanism control means according to the invention is described hereinbelow with reference to the drawings.

Figure 1:
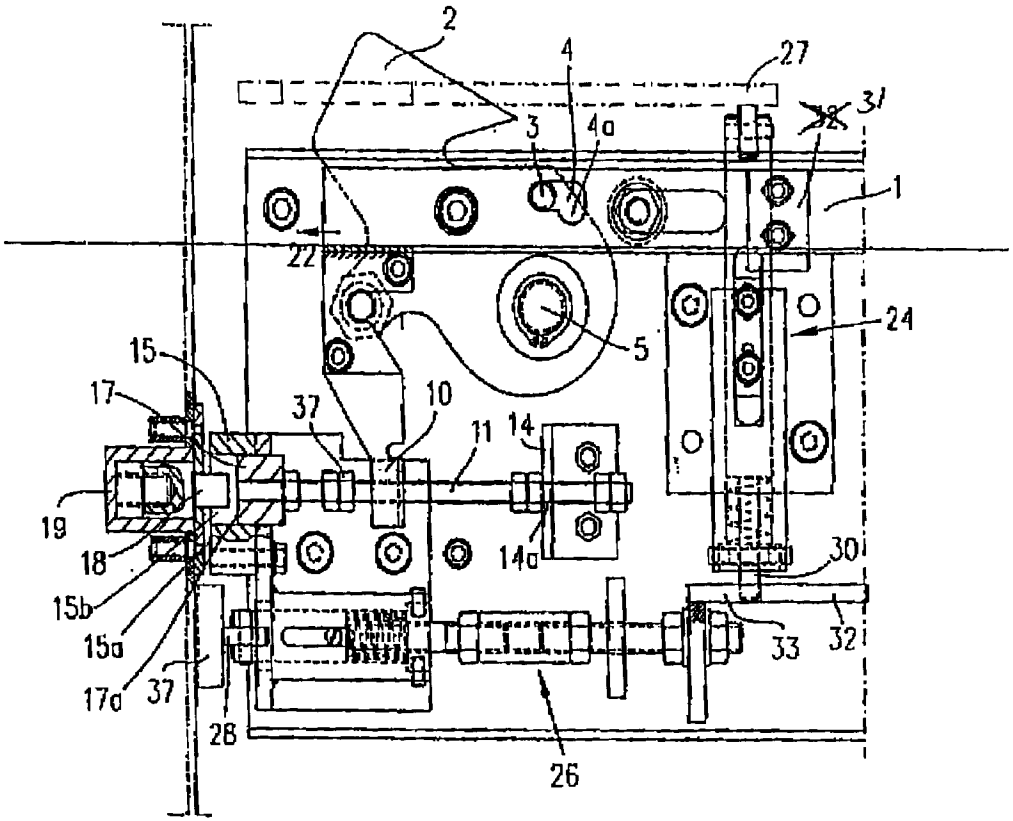
FIG. 1 shows a schematic illustration of part of the locking-mechanism control means in the state in which the door is closed and locked.

In so far as the locking-mechanism control means according to the invention has a push rod with catches articulated thereon preferably in a rotatable manner, the functioning corresponds, for example, to the already mentioned DE 196 28 010, DE 196 28 011, DE 196 28 012, to which you are referred. In the case of the locking mechanism according to the invention, a preferably vertical displaceable push rod 1 is provided on the door, the movement of said push rod being controlled via a lock or the like. Located vertically one above the other to the side of the door are a plurality of catches 2, which can each be adjusted simultaneously and in dependence on the movement of the push rod. In the locked state, the at least one catch 2 engages in corresponding openings of the door frame, these openings not being indicated specifically. It is possible to provide in the door, in addition to the catches 2, a secondary lock which, as appropriate, is likewise actuated by a lock or the like. FIG. 1 shows one of the catches 2 in the extended position, i.e. in its locking position, the catch 2 in the embodiment according to FIG. 1 constituting the uppermost door-mounted catch which, via a driver pin 3, is in functional engagement with a corresponding, preferably L-shaped guide 4 in the push rod 1. The driver pin 3 is fixed on the relevant catch 2. Rotation in the catch 2 takes place about a spindle which is designated 5, and about which the catch 2 is mounted in a rotatable manner. It can be seen that the catch 2 or the rotary spindle 5 is mounted on the door, to the side of the push rod 1. The position of the catch 2 in its two end positions can be gathered from a comparison of FIGS. 1 and 2. On the push rod 1, an arresting element 7 is provided for the catch 2, said element having a recess 7*a* which engages with a pin 8 or the like, projecting laterally from the catch 2, when the catch 2 or all the catches 2 assumes/assume the locking position shown in FIG. 1. This prevents the catch or catches 2 being displaced into an open position by the use of force from the outside.

In the case of a preferred embodiment, the arresting element 7 is provided with a driver element 10, it also being possible for the driver element 10 to be fitted directly on the push rod 1. The driver element 10 can be displaced in relation to a piston rod 11, in the direction of the axis of the piston rod 11. In the case of the embodiment shown in FIGS. 1 and 2, the piston rod 11 is preferably guided such that it can be displaced in a vertical direction. A first guide device 14 and a second guide device 15 are preferably provided, it being possible for these to be formed respectively, for example, by guide plates with an opening corresponding to the piston rod and by a guide cylinder for a cylindrical element 17 provided on the piston rod 11. In the case of the embodiment illustrated, the guide device 14 is fastened on the door and has an opening 14*a* through which the piston rod 11 is guided in the region of its right-hand end, as seen in FIG. 1. The second guide device 15 here comprises a cylindrical part with a cylindrical element 17 guided therein.

Coaxially in relation to the cylindrical guide device 15, which is provided on the door, a blocking bolt 18 is located on the frame, which bolt can be adjusted coaxially in relation to, or in alignment with, the piston rod 11 and is prestressed in the direction of the door by a spring (not shown). The compression spring, which prestresses the blocking bolt 18 downwards or in the direction of the door, is arranged within a cylindrical accommodating part 19.

If the door is closed (FIG. 1), the blocking bolt 18 protrudes in relation to the frame and projects into the cylindrical guide device 15, as a result of which opening of the door is ruled out when the piston rod 11, with the cylindrical element 17, has been displaced back into the door in relation to the top edge, designated 15*a*, and thus makes it possible for the blocking bolt 18 to engage in the freed interior of the cylindrical guide device 15. If, in contrast, according to FIG. 2, the piston rod 11 has been displaced upwards to the top edge of the door such that the cylindrical element 17 has its upwardly oriented surface 17*a* aligned in relation to the upwardly oriented surface 15*a* of the guide device 15, or protrudes upwards in relation to the end surface 15*a*, the blocking bolt 18 is moved into its cylindrical accommodating part 19 and displaced out of engagement with the door. In this state, the door can be opened, it being the case that, during the opening operation, the blocking bolt 18 runs off on a sloping run-off path 20, which adjoins the guide device 15 on the door. In this respect, you are referred to FIG. 3, which illustrates, schematically, the run-off path 20 to the side of the cylindrical guide device 15. During closure of the door in the case of the preferred embodiment, in contrast, the blocking bolt 18 runs on the top edge of the door, along the path 20, until the door is located within the frame and the blocking bolt 18 is coaxial in relation to the cylindrical element 17, in order, once the piston rod 11 has been moved back, to engage in the cutout which has been released as a result within the guide device 15, above the drawn-back cylindrical element 17.

Figure 2:
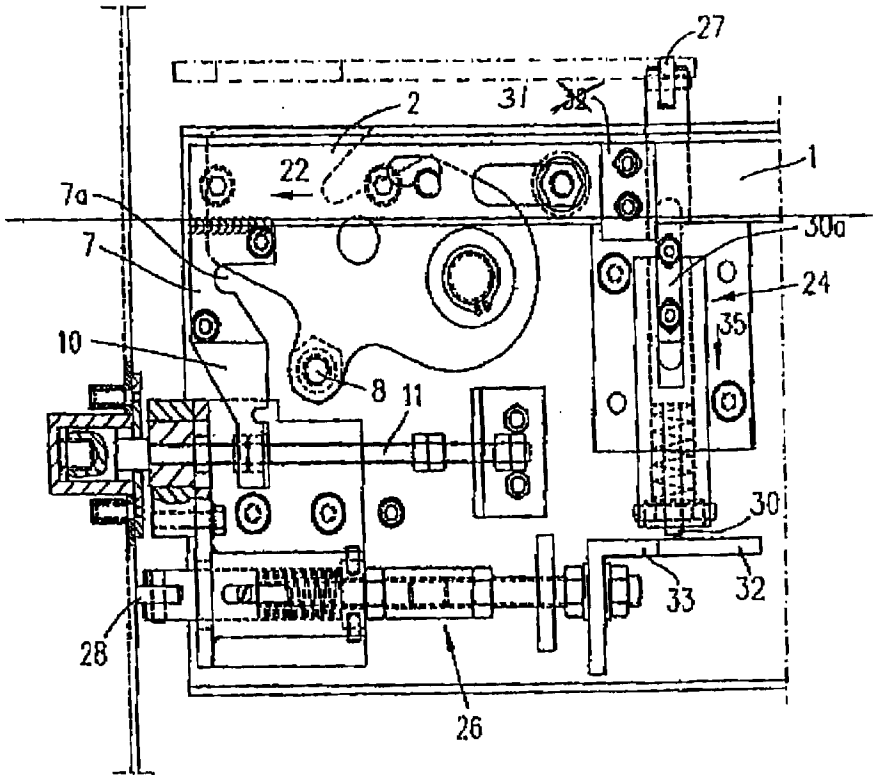
FIG. 2 shows an illustration of the locking-mechanism control means for the purpose of explaining the state when the door is open and unlocked.
Figure 3:
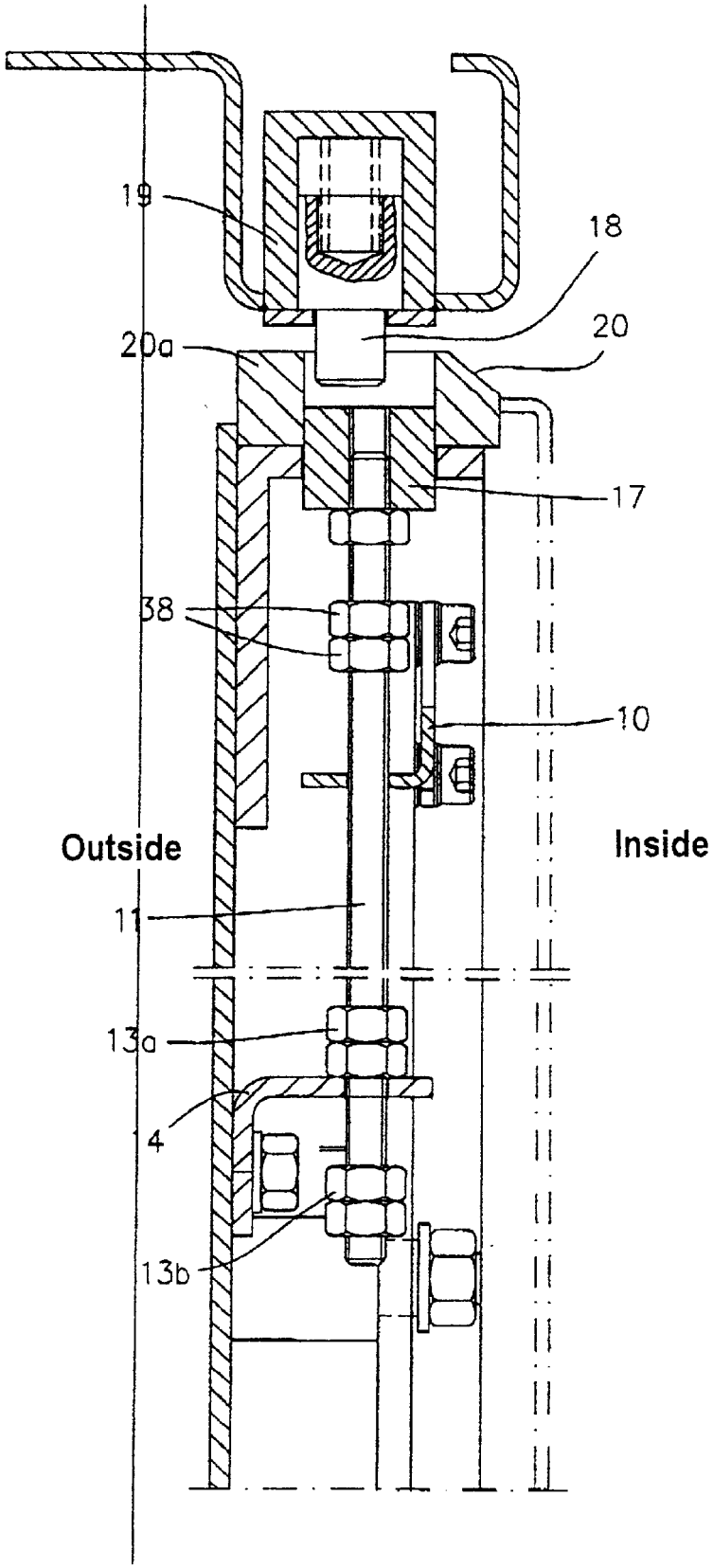
FIG. 3 shows a view of part of the door for the purpose of explaining further details.

FIG. 1 shows the state in which the door is closed and the blocking bolt 18 engages in the freed opening with the guide device 15, above the cylindrical element 17, while according to FIG. 3 the door has been displaced into the "open" position by corresponding actuation of the door handle, which is not illustrated in FIG. 3. In the latter state, the push rod 1 has been displaced upwards in relation to FIG. 1, as a result of which the catch 2 assumes it dashed position in FIG. 2 and allows the door opening, into which the catch 2 is displaced back in the clockwise direction in FIG. 2. This rearward displacement takes place on account of the engagement of the driver pin 3, which is preferably fastened on the catch 2 and engages in the guide 4 of the push rod 1. By virtue of the push rod 1 moving in the direction of an arrow designated 22, the catch 2 or the catches is/are thus pivoted by the driver bolt 3 until each catch 2 assumes the open position shown in FIG. 2. In this open position, the pin 8 does not engage with the cutout 7*a*. Furthermore, the driver pin 3 passes into the step-like cutout designated 4*a* within the push rod 1, which results in the catch 2 remaining arrested in this open position. In order to achieve this setting, it is necessary for the push rod 1 to be displaced to the far left, i.e. upwards, in FIG. 2, to be precise to the extent where, at the same time, the piston rod 11 is advanced in the direction of the blocking bolt 18 to the extent where the blocking bolt 18 disengages from the guide device 15.

During subsequent opening of the door from the position shown in FIG. 2, a first blocking device, designated 24, and a second blocking device, designated 26, is s activated. Both blocking devices 24, 26 are provided, at their free end, preferably with a respective roller 27, 28, these rollers sliding along the associated door frame. For each roller 27, 28, a corresponding guide path with a corresponding slope is provided on the frame in order for the blocking devices 24, 26 to be extended slowly out of the door, in order to allow the blocking devices 24, 26, from the position shown in FIG. 1 in each case, to assume the position shown in FIG. 2 in each case. During the opening operation of the door, the blocking device 24, which is subjected to spring prestressing, is moved outwards out of the position shown in FIG. 1, which results in a blocking bolt 30, associated with the first blocking device 24, disengaging from a blocking plate 32 with recess 33, which are both constituent parts of the second blocking device 26. At the same time, the second blocking device 26, under the action of a prestressing spring (not shown), is likewise moved out of the door, to be precise in the direction of the arrow 22, until the second blocking device 26 the blocking bolt 30 of the first blocking device. This ensures that, in the open state, the first blocking device 24 is blocked against displacement into the door since the blocking bolt 30 butts wholly or partially against the blocking plate 32.

With the door in the open position shown in FIG. 2, in which the door has been unlocked at the same time, the first blocking device 24 has the function of preventing adjustment of the push rod 1 in a direction counter to the arrow 22. For this purpose, the first blocking device 24 preferably has a plate-like blocking means 30*a* which comes into abutment against a mating plate 31 or the like, provided on the push rod 1 when the door is opened and unlocked.

The closing operation takes place in reverse order. During closure of the door, the blocking devices 24 and 26 are displaced into the door such that the plate 32 is displaced in the direction counter to the arrow 22 to the extent where the opening 33 located in the plate 32 is aligned in relation to the blocking bolt 30 of the first blocking device. This makes it possible, during the closing movement of the door, for the first blocking device 24 likewise to be displaced into the door, in the direction of an arrow 35 (FIG. 2), into the position according to FIG. 1, which results in the blocking means 30*a* and the mating plate 32 disengaging and in it being possible for the push rod 1 to execute a movement in the direction counter to the arrow 22. At the same time as the push rod is moved in the direction counter to the arrow 22, the piston rod 11 is displaced into the door, i.e. drawn back, more or less parallel to the push rod 1, this resulting in displacement of the cylindrical element 17 within the guide device 15, with the result that the blocking bolt 18 can engage in the opening which is released as a result within the guide device 15.

Both the first and second blocking devices 24, 26 are subjected to spring prestressing, with the result that the associatet rollers 27, 28 are extended automatically out of he door as soon as the door is opened, and the rollers 27, 28 slide along the door frame on a correspondingly sloping run-off path.

Acomparison between FIGS. 1 and 2 shows that, in the state accordiing to FIG. 1, i.e. when the door is closed and locked, the first and the second blocking devices 24, 26 have been retracted into the door, the second blocking device 26 butting, by the way of the roller 28, against a run-off path 37, of which the surface is offset in the direction of the door in relation to the associated door frame, while in the state accordiing to FIG. 2 the two blocking devices have been extended, by way of the rollers 27, 28, in relation to the door.

The functioning of the locking-mechanism control means according to the invention is explained briefly hereinbelow taking FIG. 1 as the departure point. If the door is closed and locked, all the catches 2 are extended, and the push rod 1 is located in a position in which it assumes a so-called "bottom" position. It should be noted here that the illustration according to FIG. 1 shows an embodiment in the case of which that frame part which accommodates the blocking bolt 18 forms the top end side of the frame and that part of the door which contains the guide device 15 constitutes the top end side of the door. The catches 2, on the other hand, are located on the freely movable lateral section of the door. The push rod 1 is arranged vertically and is displaced between a bottom position (FIG. 1) and a top position (FIG. 2). By virtue of the corresponding adjustment of a door handle or the like, the push rod 1 from FIG. 1 is displaced in the direction of the arrow 22, which results in all the catches 2 being rotated in the anticlockwise direction about their spindle 5. At the same time as the movement of the push rod 1, the arresting element articulated thereon, or the driver 10 connected to the push rod 1, is likewise displaced in the direction of the arrow 22, as a result of which the driver 10, as a result of engaging with an arresting means, for example in the form of nuts 38 arranged on the piston rod, executes a movement of the push rod 1 parallel to the arrow 22 and thus forces the cylindrical element 17, located at the top end of said rod, against the blocking bolt 18 until the cylindrical element 17 projects upwards slightly beyond the guide device 15 and the blocking bolt 18 disengages from the guide device 15. This means that the end surface 17*a* of the element 17 projects beyond the end surface 15*a* of the guide device 15. This ensures that the blocking bolt 18 disengages from the door. As soon as this state is reached, the door can be opened, and the first and second blocking devices 24, 26 are adjusted such that, on account of the spring prestressing, the two blocking devices are extended until they reach the state which is shown in FIG. 2.

As the partial view according to FIG. 3 shows, there is located, on the inside of the door, a run-off path 20 in the form of a slope which, during closure of the door, causes the blocking bolt 18, during the closing movement of the door, to slide upwards along the path 20 and to be pushed back in the upward direction until, when the door is closed, it can be advanced downwards again into the cutout 15*b*. The guide device 15 thus comprises, on the one side, the run-off path 20 and, on the other side, a preferably cylindrical subsection 20*a*.

Although the locking-mechanism control means according to the invention has been described above in relation to an embodiment which has a frame-mounted securing unit with the blocking bolt 18 and the associated adjusting device in the form of the piston rod 11 located in the vertical direction and on the top side of the door, this entire unit may also be provided on that side of the door which is freely movable or also on the bottom side of the door. If appropriate, a deflecting unit is provided between the piston-rod unit 11 and the push rod 1 in order for the movement of the piston rod 11 to be transmitted correspondingly to the piston-rod unit 11 should this be necessary.

In the case of the embodiment described, the driver or driver arm 10 engages over a mating stop in the form of, for example, nuts 38, which are screwed onto the piston rod 11, and thus moves the piston rod 11 in the direction of the arrow 22 when the push rod 1 moves in the direction of the arrow 22. In the case of a further embodiment, the driver 10 is fixed to the piston rod 11 such that, when the push rod 1 moves counter to the direction of the arrow 22, the piston rod is moved along correspondingly. In contrast to this, in the case of the embodiment illustrated, the piston rod 11, on account of the dead weight, is moved counter to the direction of the arrow 22 when the driver 10 releases the device 38. The piston rod 11 may, if appropriate, be spring-prestressed, to be precise counter to the direction of the arrow 22.

While the device 38 serves to make it possible to make an adjustment in respect of the point of engagement in relation to the driver 10, it is the case with the exemplary embodiment illustrated that corresponding securing devices, which are designated 13*a* and 13*b*, are formed on the bottom side of the rod 11. The securing device in the form of the nuts 13*a* serve for defining the lowermost position of the rod 11, while the securing device or nuts 13*b* serves/serve for fixing the uppermost position of the rod 11.

Figure 4:
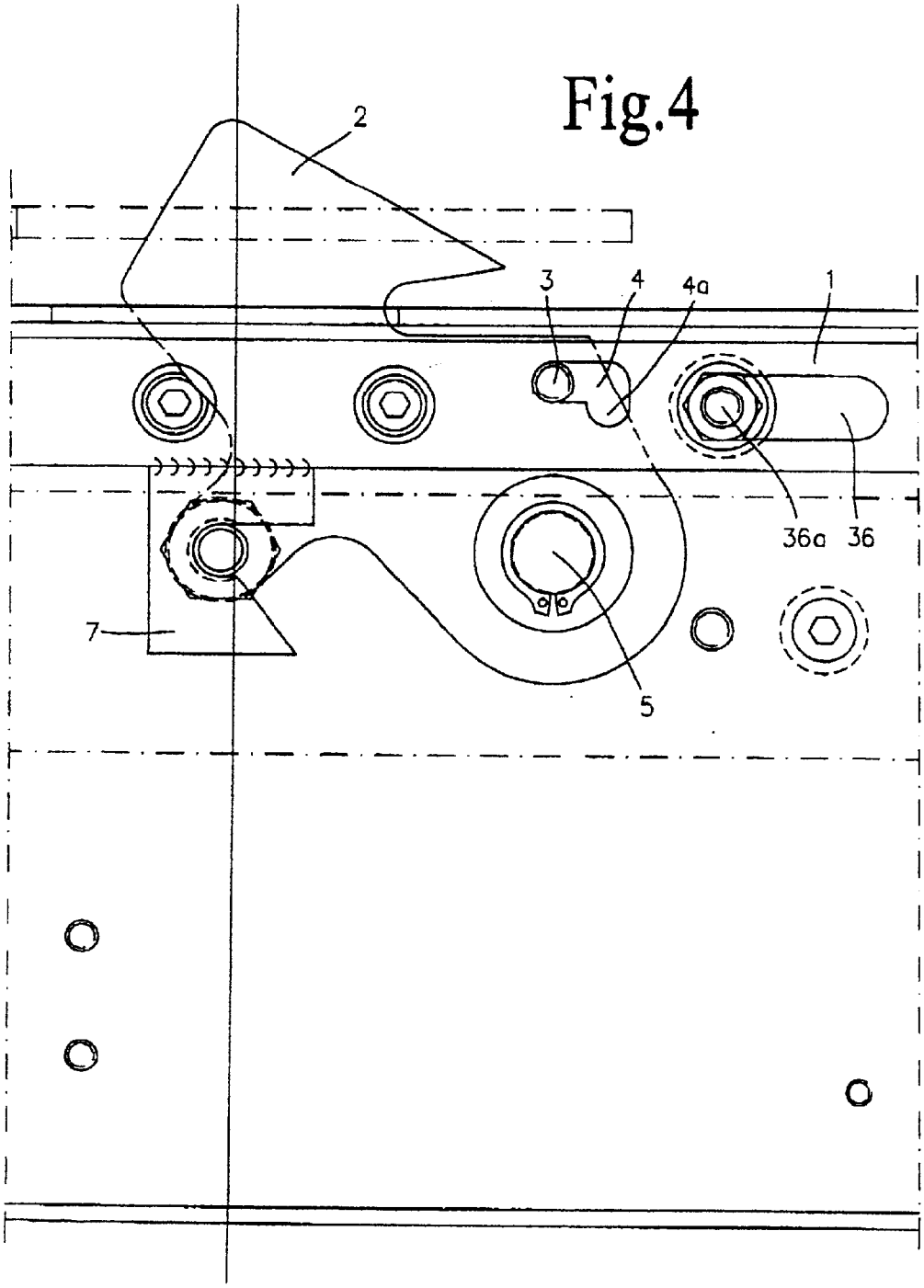
FIG. 4 shows an illustration of a door-mounted catch for the purpose of explaining the position of the latter when the door is closed.
Figure 5:
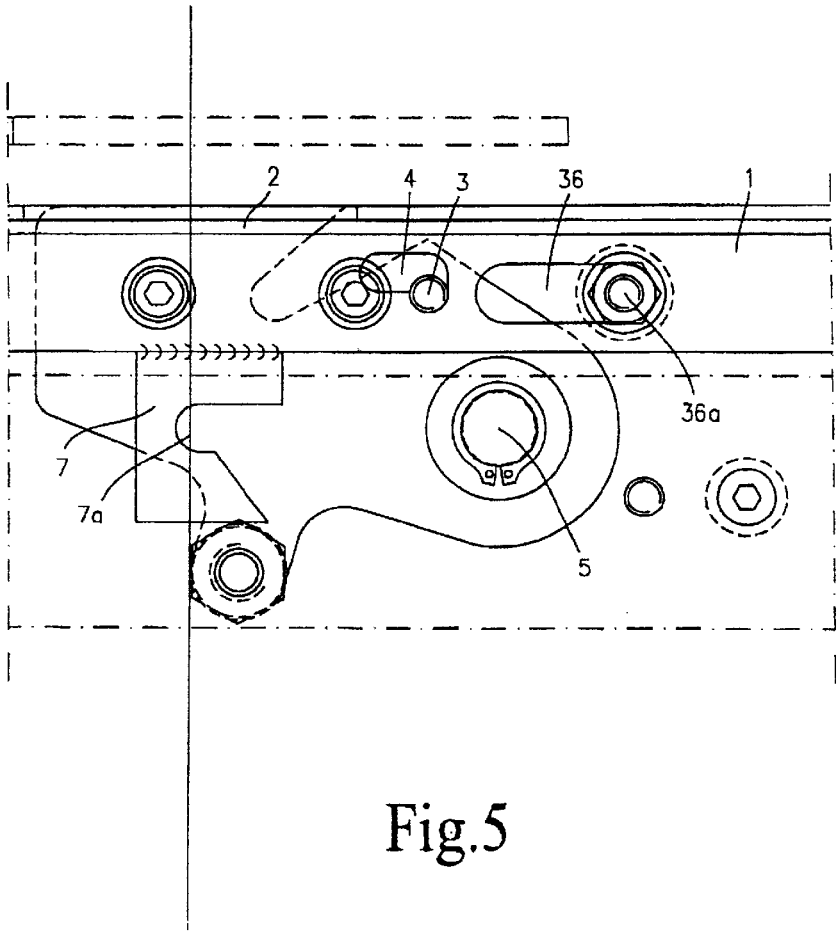
FIG. 5 shows an illustration corresponding to FIG. 4, in which the catch is shown in the open position.

FIGS. 4 and 5 show, in detail, the position of the catches 2. FIG. 4 represents the state of the catch or catches 2 when the door is closed and locked, while FIG. 5 illustrates the state of each catch 2 in which the door is opened and unlocked. In the closed and locked state, the driver pin 3 is located in a section of the guide 4 which runs largely parallel to the push rod 1, while in the open and unlocked state of the door the driver pin 3 has been displaced into the blocking section 4*a* such that the catch 2 is blocked against rotating further out of the door into the state according to FIG. 4 if the push rod 1 remains unactuated. In the closed and locked state, in contrast, each catch 2 is additionally arrested by the arresting element 7, with the result that a forcing action from the outside does not make it possible to displace the catches 2 into an open position.

The push rod 1 has one or more guide slots 36 in which guide elements in the form of guide pins 36*a* engage for the purpose of guiding the push rod 1 during the movement of the same.

Figure 6:
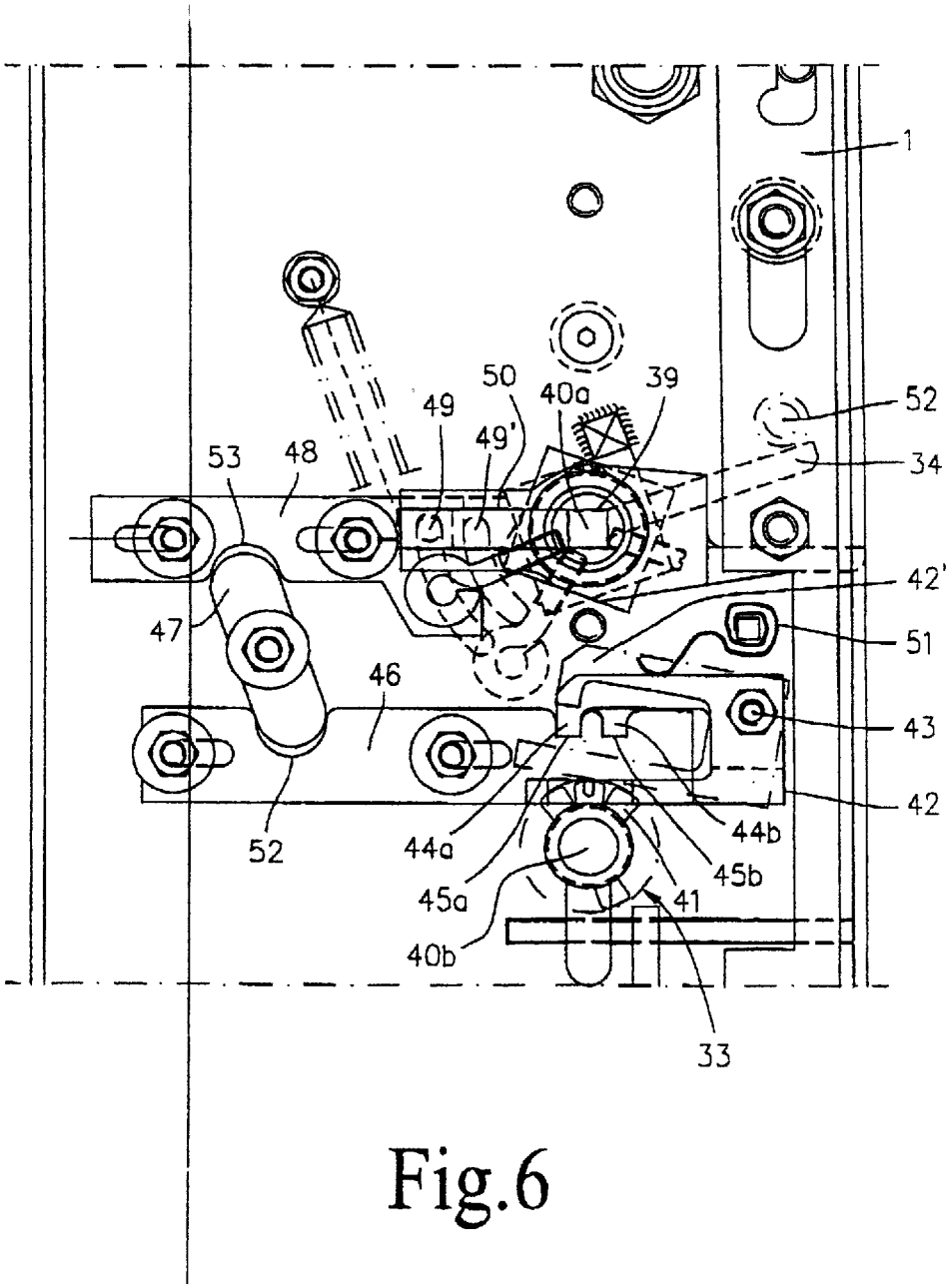
FIG. 6 shows an exemplary embodiment of the door lock with the mechanical connection to the push rod.

FIG. 6 shows an example of the lock unit or door-handle-actuation unit for the purpose of adjusting the push rod 1. In the case of the embodiment illustrated, activating the lock cylinder 40*b* by means of a key or the like moves a nose 41 of the lock cylinder, which results in a lever which is designated 42 being adjusted into its position illustrated by dashed lines, at 42', in FIG. 6. This, for example, U-shaped lever 42 is mounted such that it can be rotated about a spindle 43. On one of its free legs, the lever 42 has tooth-like protrusions 44*a*, 44*b*, which engage in corresponding accommodating grooves 45*a*, 45*b* of a rod 46 when the push rod 1 is located in its blocking position. By virtue of the nose 41, the lever 42 is rotated in the clockwise direction about the spindle 43, as a result of which its teeth 44*a*, 44*b* release the grooves 45*a*, 45*b* of the rod 46 and the rod 46 is displaced to the left in FIG. 2 by virtue of movement of the nose, in the anticlockwise direction, about the associated spindle. In the case of this embodiment, the movement of the rod 46 rotates a coupling element 47, for example in the form of a rocker 47, in the clockwise direction, as a result of which a further rod 48 which is coupled thereto is displaced. The rod 48 bears a bolt 49 or the like which, for its part, is moved together with the rod 48, corresponding to the movement direction of said rod 48, until it assumes a position illustrated by dashes, which is designated 49'. The bolt 49 runs perpendicularly to the rod 48 and, by virtue of the rod 48 being displaced, is displaced into a slot or a cutout 50 of the shaft 39, on the one hand, and of the driver lever 34, on the other hand, as a result of which the shaft 39 and the driver lever 34 are coupled mechanically to one another. Rotation of the driver lever 34 in the anticlockwise direction causes the push rod to be adjusted upon actuation of a handgrip, door handle or the like which is connected to a square stub 40*a*. In the case of the preferred embodiment illustrated, the rocker 47 is mounted approximately centrally on a spindle and has its two free ends inserted into corresponding cutouts 52 and 53 of the respective rods 46 and 48. The rods 46, 48 are guided by guide pins, which are not indicated specifically and engage in longitudinal slots of the rods 46, 48.

The lever 42, of essentially U-shaped configuration, is prestressed by a spring 51 such that the lever 42 is prestressed in the anticlockwise direction in relation to the spindle 43 and, by way of its first leg, which bears the teeth 44*a*, 44*b*, engages with the cutouts 45*a*, 45*b* of the rod 46. Activation of the lock cylinder and rotation of the nose 41 of the latter thus rotate the lever 42 in the clockwise direction about a spindle 43, with the result that the nose 41, for the purpose of rotating the lever 42, acts on the leg which is located opposite the leg which bears the teeth 44*a*, 44*b*. As soon as the nose 41 of the lock cylinder 40 is no longer acting on the associated leg of the lever 42, the lever 42 is set back, by the action of the spring 51, into its starting position, in which its arresting teeth 44*a*, 44*b* engage with the associated arresting grooves 45*a*, 45*b* of the rod 46.

It is thus the case overall with the embodiment shown that adjustment of the push rod 1 is only possible when the lock is activated correspondingly and then a door handle, lever or the like which is connected to the square stub 40*a* is actuated. According to the invention, this achieves the situation where the door can only be opened when the door handle with the square stub 40*a* is actuated to the extent where, on the one hand, all the catches 2 are rotated into the open position and, on the other hand, the push rod 1 is moved to the extent where the piston rod 11 is raised or displaced into the position according to FIG. 2, with the result that the door is released in respect of the blocking bolt 18.

Although it is a specific embodiment of a mechanical coupling between the lock, on the one hand, and push rod 1, on the other hand, which has been illustrated above, it is also possible to use any other configuration of lock. If the lock according to FIG. 6 is actuated into the blocking or locking position, horizontally arranged blocking bolts, which are not illustrated specifically and are provided in addition to the catches 2, can be extended from the door into the frame located opposite. It can be seen that it is also possible to use any other manner of lock actuation in order for the push rod 1 to be displaced in the vertical direction so as to reach the positions shown in FIGS. 1 and 2.

By virtue of a corresponding adjustment between the device 48, on the one hand, and the driver 10, on the other hand, it is possible to ensure that, with the catches 2 retracted, door opening is possible when, and only when, the piston rod 11 has had its top pressure-exerting element 17 displaced beyond the guide device 15 to a slight extent. This rules out any movement of the catches 2 back into an "extended" state similar to FIG. 3. It is also thus ensured that, once the door has been opened, the catches 2 remain in the retracted position until the door is displaced in the direction of the frame and closed, in which case it is only then that the catches 2 can be extended out of the door again.

What is claimed is:

1. Door, comprising:

a locking-mechanism control means and at least one door-mounted catch suitable to lock the door, wherein the control means is provided for controlling said at least one catch;

a surrounding door frame having openings with which said at least one catch is engaged for locking the door;

a push rod being provided for controlling the adjustment of said at least one catch;

first and second adjustable blocking devices arranged within said door, wherein the movement of said first and second blocking devices is controlled in dependence on the door movement such that said first and second blocking devices are retracted into the door when the door is closed and locked;

a driver and a further rod, wherein said driver is provided on said push rod and coupled to said further rod, said door frame comprising an arresting bolt and a spring device, said spring device being provided for biasing said arresting bolt in the direction of said door, wherein one of said blocking devices is provided for arresting the push rod in an open position when the door is open, said further rod being arranged for executing a movement corresponding to the movement of said push rod to shift said arresting bolt such that said arresting bolt engages with the door in its closed state, said arresting bolt being displaced out of engagement with the door in its open position by a movement of said further rod in a direction out of the door.

2. Door, comprising:

a locking-mechanism control means and at least one door-mounted catch suitable to lock the door, wherein the control means is provided for controlling said at least one catch;

a surrounding door frame having openings with which said at least one catch is engaged for locking the door;

a push rod being provided for controlling the adjustment of said at least one catch;

first and second adjustable blocking devices being arranged within said door, wherein the movement of said first and second blocking devices is controlled in dependence on the door movement such that said first and second blocking devices are retracted into the door when the door is closed and locked;

a driver and a further rod, wherein said driver is provided on said push rod and coupled to said further rod, said door frame further comprising arresting bolt and a spring device, said spring device being provided for biasing said arresting bolt in the direction of said door, wherein one of said blocking devices is provided for arresting the push rod in an open position when the door is open, said further rod being arranged for executing a movement corresponding to the movement of said push rod to shift said arresting bolt such that said arresting bolt engages with the door in its closed state, said arresting bolt being displaced out of engagement with the door in its open position by a movement of said further rod in a direction out of the door, an arresting opening which is provided in said door, said arresting bolt engaging in said arresting opening when the door is in its closed position.

3. Door according to claim 1, wherein said further rod is a piston rod which is provided on said door and comprises means for a mechanical coupling to said driver.

4. Door according to claim 1, wherein said further rod is provided parallel to said push rod within the door.

5. Door, comprising:

a locking-mechanism control means and at least one door-mounted catch suitable to lock the door, wherein the control means is provided for controlling said at least one catch;

a surrounding door frame having openings with, which said at least one catch is engaged for locking the door;

a push rod being provided for controlling the adjustment of said at least one catch;

a first and second adjustable blocking devices being arranged within said door, wherein the movement of said first and second blocking devices is controlled in dependence on the door movement such that said first and second blocking devices are retracted into the door when the door is closed and locked, a driver and a further rod, wherein said driver is provided on said push rod and coupled to said further rod, said door frame further comprising an arresting bolt and a spring device, said spring device being provided for biasing said arresting bolt in the direction of said door, wherein one of said blocking devices is provided for arresting the push rod in an open position when the door is open, said further rod being arranged for executing a movement corresponding to the movement of said push rod to shift said arresting bolt such that said arresting bolt engages with the door in its closed state, said arresting bolt being displaced out of engagement with the door in its open position by a movement of said further rod in a direction out of the door, a first and a second guide device which are provided for guiding said further rod.

6. Door according to claim 5, wherein said further rod comprises an adjustable piston element being movable along said second guide device.

7. Door according to claim 5, wherein said further rod comprises means for engaging with said driver, said means being provided in an adjustable manner on said rod.

8. Door according to claim 5, further comprising a run-off path which is provided on the door for guiding said arresting bolt which is moved along said run-off path, wherein said run-of path is provided with a predetermined slope.

* * * * *